US005943475A

United States Patent [19]

Jackson

[11] Patent Number: 5,943,475

[45] Date of Patent: Aug. 24, 1999

[54] HEATING ELEMENT FOR WATER HEATERS WITH SCALE CONTROL

[75] Inventor: Barry N. Jackson, Woodbury, Minn.

[73] Assignee: Water Heater Innovations, Inc., Eagan, Minn.

[21] Appl. No.: 09/187,782

[22] Filed: Nov. 6, 1998

Related U.S. Application Data

[62] Division of application No. 08/766,426, Dec. 12, 1996.

[51] Int. Cl.[6] ..... H05B 3/40; H05B 3/02

[52] U.S. Cl. ..... 392/497; 392/451; 392/457; 219/481

[58] Field of Search ..... 392/497, 501, 392/441, 449, 451, 457; 219/481, 538, 540

[56] References Cited

U.S. PATENT DOCUMENTS

| | | | |
|---|---|---|---|
| 5,293,446 | 3/1994 | Owens et al. | 392/449 |
| 5,774,627 | 6/1998 | Jackson | 392/497 |

*Primary Examiner*—Teresa Walberg
*Assistant Examiner*—Thor S. Campbell
*Attorney, Agent, or Firm*—Moore & Hansen

[57] ABSTRACT

An improvement in electrical elements for a water heater includes a mass attached to the element for reducing the deposition of hard water scale on element surfaces, particularly in the return bend areas. In one embodiment, a flow accelerator tube encloses the element. The flow accelerator tube has an inlet at one end and an outlet at a higher elevation at the opposite end. Water is induced to flow through the tube because of temperature change. In another embodiment, a solid mass with high surface area encloses the return bend areas to increase heat transfer at a lower temperature to reduce scaling and increase element life.

6 Claims, 10 Drawing Sheets

HEATING ELEMENT FOR WATER HEATERS WITH SCALE CONTROL

This is a division of application Ser. No. 08/766,426 filed Dec. 12, 1996.

BACKGROUND OF THE INVENTION

This invention relates generally to electrical water heaters. More particularly, this invention pertains to heating elements for electrical water heaters used to heat water containing hardness values which tend to coat heating surfaces with scale.

Conventional electric water heaters have elongated heating elements comprising an outer tubular sheath enclosing an inner electrical resistance wire. The resistance wire is connected at each end of the element to electrical terminals in a flange or other mount for electrical activation. Typical element designs include at least one return bend with a short radius enabling passage of the element through an entry port. Additional bends may be provided to lengthen the element and increase the heating surface area.

In a typical element, the internal metallic resistance wire is surrounded by a material such as magnesium oxide which is an electrical insulator but is capable of a reasonably high heat transfer rate. The outer sheath may be formed of a metal such as copper or INCOLLOY material. Thermal energy passes from the hot resistance wire through the insulating material and sheath wall to the sheath surface, thereby heating the water.

It is theoretically desirable to design the element for a high heat evolution, measured as "watt density", i.e. units of power per unit sheath external heat transfer area.

In nearly all uses of water heaters, the water contains precipitatable chemical compounds measured as "hardness". These compounds, including calcium sulfate, typically precipitate on the hot sheath surfaces, forming a heat insulative scale comprising salts of sulfates, carbonates, oxides, etc.

In the absence of significant scale on the sheath, the heat transfer mechanism keeps the electrical resistance wire at a relatively low temperature. As a layer of scale accumulates on the sheath surface, the resistance to heat transfer increases rapidly, and the temperature of the resistance wire, magnesium oxide and sheath increases. The deleterious effects of such scale-induced elevated element temperatures are well-known, and include:

a. decreased heat transfer rate;

b. increased rate of scaling at the higher temperatures;

c. "burn-out" of the resistance wire due to oxidation and melting at the high temperatures;

d. cracking or breaking of the sheath due to high temperature stress; and e. the required frequent replacement of the heating elements.

Scale accumulation is significantly greater at sharp bends in the element. The sheath area for heat transfer is reduced at the interior portion of the bends, resulting in higher temperatures in this area. The rate of scale formation at bends is significantly greater than in straight areas, and the scale eventually fills the interior portion of the bend. The result is very high element temperatures at the bends. Aggravating this problem are the increased stresses and potential surface cracking resulting from the bending operation in these areas.

Various solutions have been proposed or used to allay the problems created by scaling of heating elements.

In one method, the watt density is reduced so that the scale will form at a lower rate, thus extending the element life. This may be accomplished by using a resistance wire of lower wattage rating, or increasing the sheath diameter and/or length. The disadvantages of this method are that an element of greater surface area is required, causing difficulties in fitting the element into small heater tanks and/or increasing the cost through (a) enlarged element size and (b) enlarged port and element mount size and greater required strength thereof.

Another method for reducing scaling problems comprises the use of elements having greater-than-normal watt density. The element is intended to heat very rapidly when turned ON so that the element expands rapidly, thereby "flaking" off the scale from the sheath surface. This method sometimes works, depending upon the chemical structure of the scale. It has been observed that even using such a method, a high degree of scaling will eventually occur. The increased watt density makes the element less tolerant of scale, i.e. the element temperature rises more rapidly per unit thickness of scale, resulting in high element temperatures. Failure of the element typically occurs very prematurely.

BRIEF SUMMARY OF THE INVENTION

In order to eliminate or ameliorate the scaling problems associated with current electric water heaters, the element is designed so that scaling is minimized.

In a first aspect of the invention, a high velocity of water is provided to increase the overall rate of heat transfer as a result of (a) scouring of scale from the element and (b) high heat transfer rate resulting from the high water velocity across the element surface. This result is achieved by shrouding the element with an elongate hollow flow accelerator tube having a lower water inlet end and an upper water outlet end. Water is drawn from a cooler portion of the water heater vessel and discharged into a hotter portion of the vessel. The flow of water through the tube and past the element is accelerated by the heating process and resulting difference in specific gravity of the water. Baffles may be incorporated into the flow accelerator tube to direct the high velocity water stream into the interior bend portions. In another particular embodiment, the flow accelerator tube has an attached resistance wire and itself comprises the heating element.

In another version of the invention, a device comprising a solid metallic heat sink is provided with a cavity into which a return bend of the element is inserted for intimate contact therewith. The heat sink has a greater heat transfer surface than the element itself, and has a low heat resistance, resulting in rapid transfer of thermal energy from the element. As a result, the degree of scaling in the bend areas is much decreased, and destructive elevated temperatures which would otherwise occur in the element itself are much delayed or avoided completely.

These and other features and advantages of the invention will be readily understood by reading the following description in conjunction with the accompanying figures of the drawings wherein like reference numerals have been applied to designate like elements throughout the several views.

DESCRIPTION OF THE PREFERRED EMBODIMENTS

Figure 1:
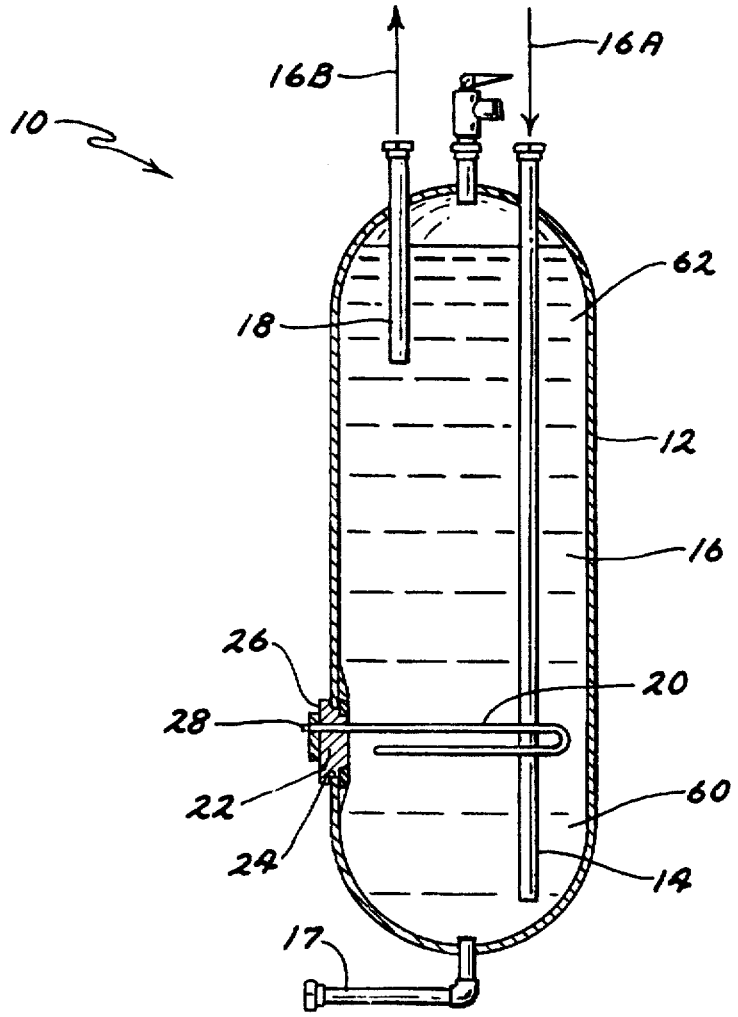
FIG. 1 PRIOR ART
FIG. 1 is a simplified sectional side view of a conventional waterheater vessel of the prior art.
Figure 2:
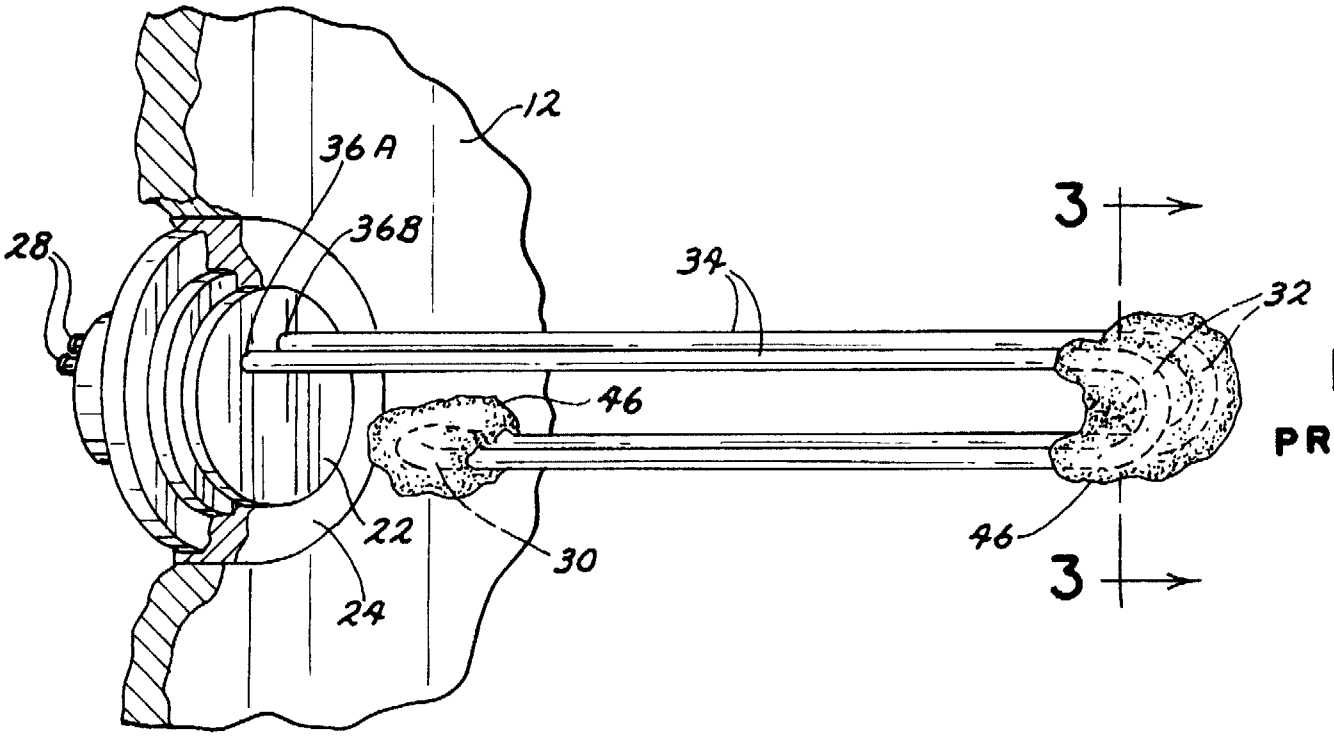
FIG. 2 PRIOR ART
FIG. 2 is a perspective view of a conventional sheath type water heater element of the prior art.

With reference to the drawings, and particularly to FIGS. 1–2, a conventional domestic water heater vessel 10 of the prior art is illustrated in simplified form. The upright vessel 10 is shown as having a wall 12 fabricated from composite plastic material, although steel or other suitable material may be used. The vessel 10 is shown with a water inlet 14 for admitting cold water 16A, and a water outlet 18 for discharging heated water 16B. A standard drain tube assembly 17 is connected to the bottom of the vessel 10. An elongate sheath type water heater element 20 has a mount 22 for sealing installation in port 24 through wall 12. The exterior side 26 of mount 22 includes terminals 28 for electrical connection of a power source, not shown, to the element, for heating the element 20 and thus the water 16 in the vessel 10.

Figure 3:
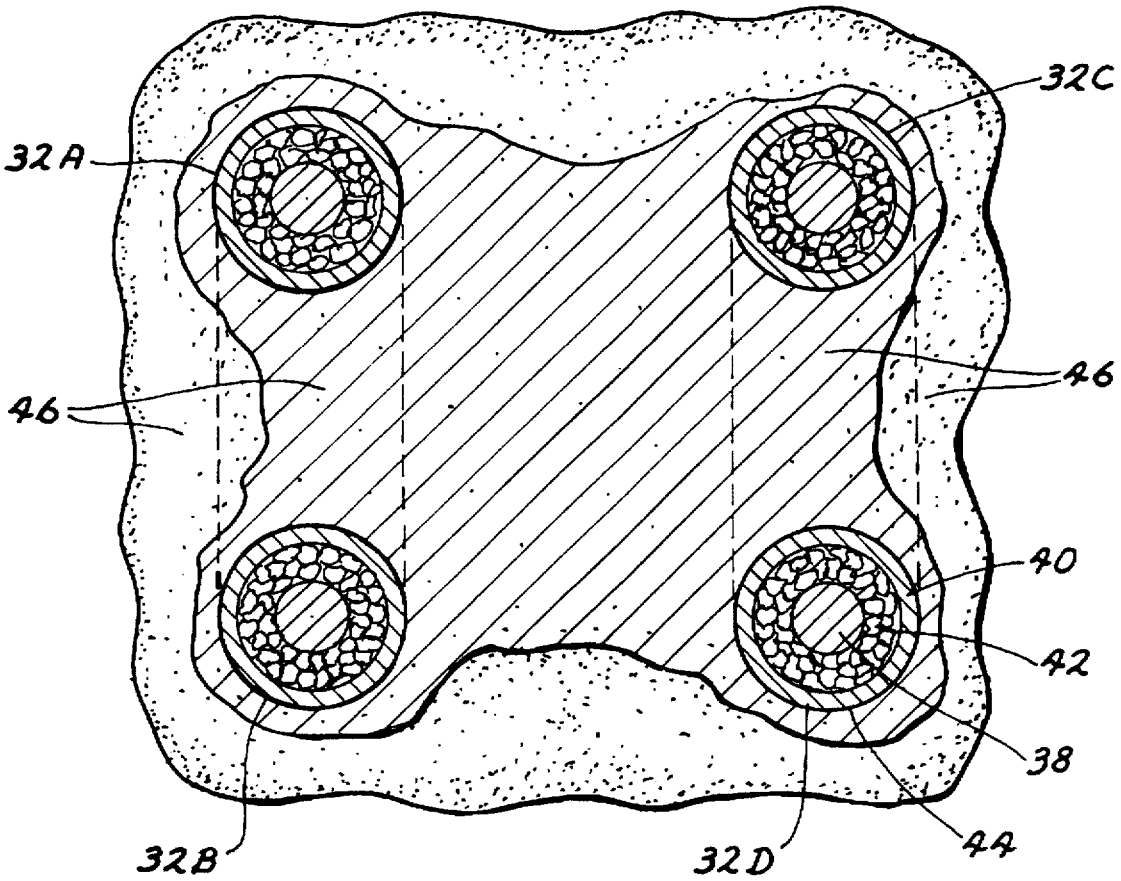
FIG. 3 PRIOR ART
FIG. 3 is an enlarged cross-sectional view through a prior art operating water heater element as taken along line 3—3 of FIG. 2.

For purposes of illustration, FIG. 2 shows the heating element 20 as having a primary return bend 30 and secondary return bends 32. In this form of the element 20, straight sections 34 connect the bends 30, 32 and lead to the terminal ends 36A, 36B which pass through mount 22. As shown in FIG. 3, an elongate resistance wire 38 within the element 20 is connected across an electrical power supply on the exterior side 26 of the mount 22, as previously described. The mount 22 may be a flange or of screw or other insertion type of fitting which fits into and seals the port 24 in the water heater vessel wall 12.

While scale 46 typically encrusts all of the external surfaces of the element 20, the scale accumulation is generally much greater at the return bends 30 and 32, and typically bridges the straight portions 34 of the element 20 near the bends, as shown in FIG. 2.

As shown in FIG. 3, the resistance wire 38 is typically separated from an outer sheath 40 by an electrically insulating, heat transmitting material 42 such as particulate magnesium oxide or a ceramic material. If no scale 46 exists on the external surface 44 of the sheath 40, surface 44 is in contact with the water 16 to be heated and comprises an efficient heat transfer surface. When coated with scale 46, the heat transfer rate is reduced and the element temperature increases. Typical scaling at a set of return bends 32 is shown as bridging the space between the element bend portions 32A, 32B, 32C and 32D. Such scaling leads to failure of the element 20.

The several versions of the invention are shown in FIGS. 4–22, and all are shown with a "bent" sheath type heating element, i.e. an element having at least one return bend.

As shown in FIGS. 1–20, the components of the invention, except where specifically stated otherwise, are depicted in mirror symmetry about a vertical, median, longitudinal plane. Consequently, a description of the parts in one side serves equally to identify the parts in the opposite side. However, the components may alternatively be formed in a non-symmetric configuration without deviating from the invention, but such is not generally the preferred embodiment.

Figure 4:
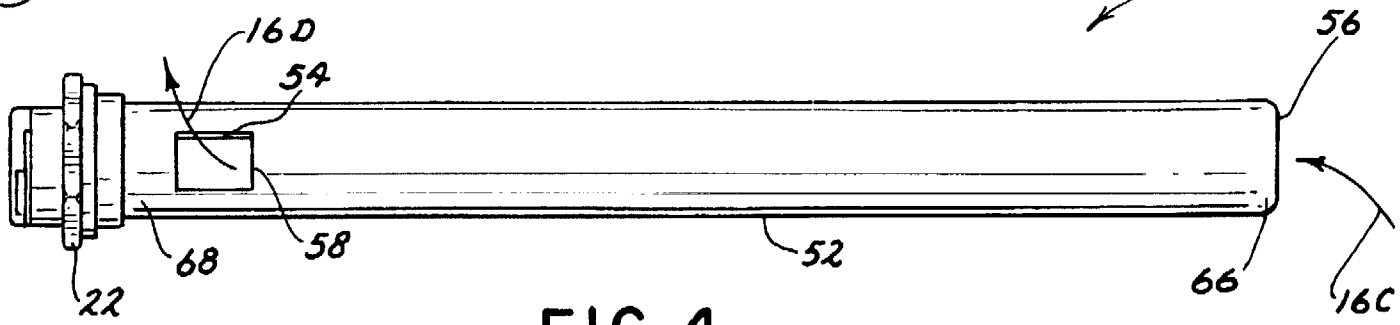
FIG. 4 is a top view of one embodiment of the invention comprising a flow tube enclosing a water heater element.
Figure 6:
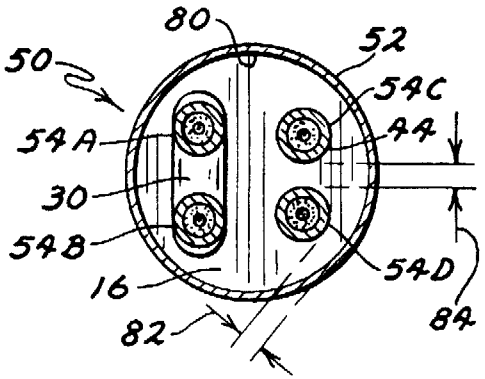
FIG. 6 is a cross-sectional end view of the flow accelerator tube and element of the invention, as taken along line 6—6 of FIG. 5.
Figure 5:
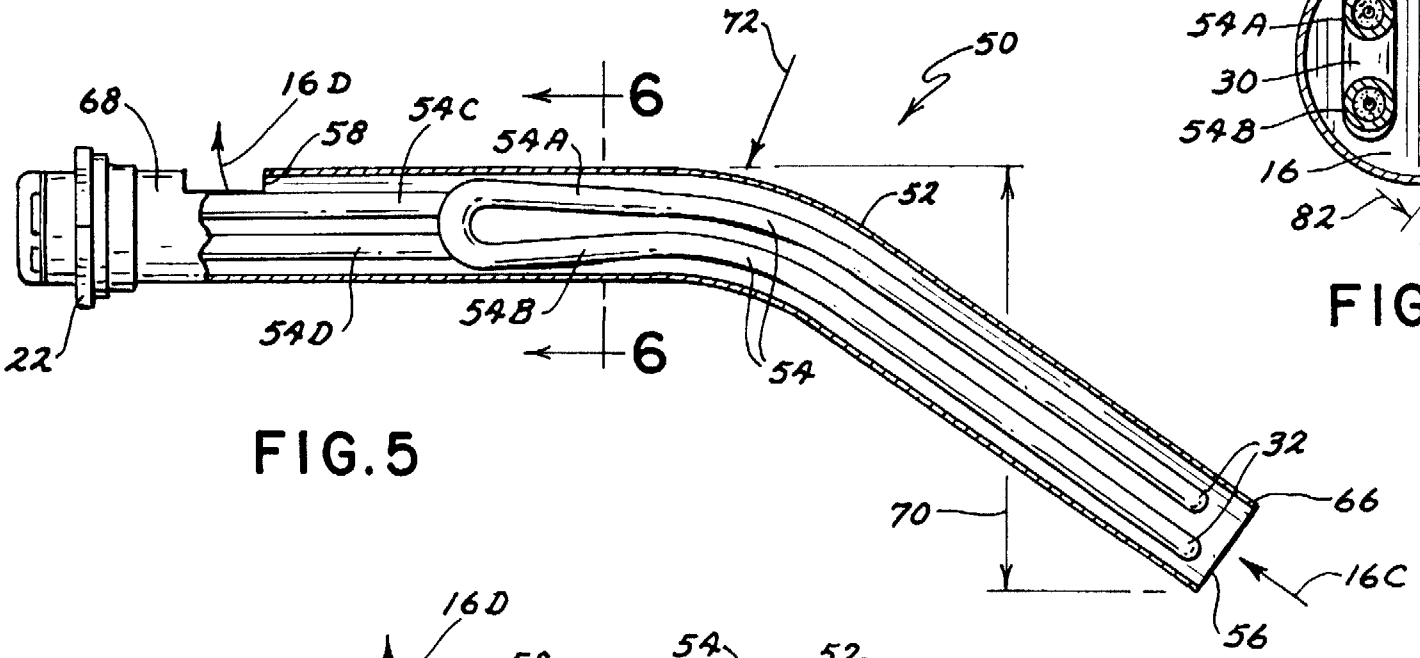
FIG. 5 is a cutaway side view of the flow tube of FIG. 4 showing an angled water heater element and flow tube.

FIGS. 4–6 illustrate one embodiment of the water heating apparatus 50, including a flow accelerator tube 52 enclosing a heating element 54. The flow accelerator tube 52 is configured to contain the bent heating element 54 and generate a rapid flow of water 16 generally parallel to the element. The rapidly flowing water 16 scours the scale from the sheath surfaces 44 as the scale is being formed.

The rapid movement of water 16 through the flow accelerator tube 52 is generated by the temperature increase of incoming water 16C as it enters the tube 52 through tube inlet 56, is heated by the element 54 and passes as heated outgoing water 16D from the tube 52 through upper outlet 58 on the top of tube 52.

As water is heated, its specific gravity and viscosity are reduced, and it tends to flow upwardly. The water inlet 56 is positioned in a portion of the water heater vessel 10 which is at a low temperature relative to the remainder of the vessel.

Typically, the temperature in the lower portions 60 of the vessel 10 will be lower than the temperature in the upper portions 62 of the vessel(see FIG. 1), and the tube inlet 56 is located at a position lower than the tube outlet 58. Thus, as seen by viewing FIGS. 4, 5 and 6, the heating element 54 and the flow accelerator tube 52 which enclose it are both bent downwardly at an intermediate location 72 to position the tube inlet 56 in a lower, i.e. cooler portion of the water heater vessel 10. A preferred, effective elevation difference 70 between inlet 56 and outlet 58 is believed to be about 4 to about 8 inches, but can be increased or decreased significantly within a range of about 2 to 18 inches, depending upon water heater vessel size and configuration. The temperature difference between the tube incoming water 16C and the tube outgoing water 16D for a given water heater will vary depending upon the flow rate of water 16 through the tube 52, the temperature of the incoming cold water 16C, the withdrawal rate of hot water from the water heater, and the quantity of scale on the element(s).

The water 16 flowing through the flow accelerator tube 52 scours scale forming material from the heat exchange surfaces of the heating element 54, particularly the surfaces in the areas of bends 30 and 32. As shown in FIG. 6, a major portion of the tube 52 will contain four element sections 54A, 54B, 54C and 54D, for the particular element illustrated.

In these figures, the tube inlet 56 is shown at the distal end 66 of the flow accelerator tube 52, and the tube outlet 58 is shown at the proximate end 68 of the tube. If desired, however, the inlet and outlet positions of the tube 52 may be reversed, provided the tube outlet 58 is maintained at the desired elevation 70 above the tube inlet 56.

By adjusting the length and diameter of enclosing tube 52, various flow rates may be achieved around the element sheath 40. The water flow rate through tube 52 is adjusted to provide an optimum cleaning action for the design of the heating element, the materials used, the watt density and the types of water conditions.

In the foregoing embodiments, it is important that the internal diameter of the flow accelerator tube 52 be such that the average distance 82 from the internal tube surface 80 to the sheath surface 44 is generally no less than about 0.8 times the intersheath distance 84 and no more than approximately twice the intersheath distance. In any case, the tube 52 must have an exterior diameter which will pass through the port in the water heater wall.

Figure 7:
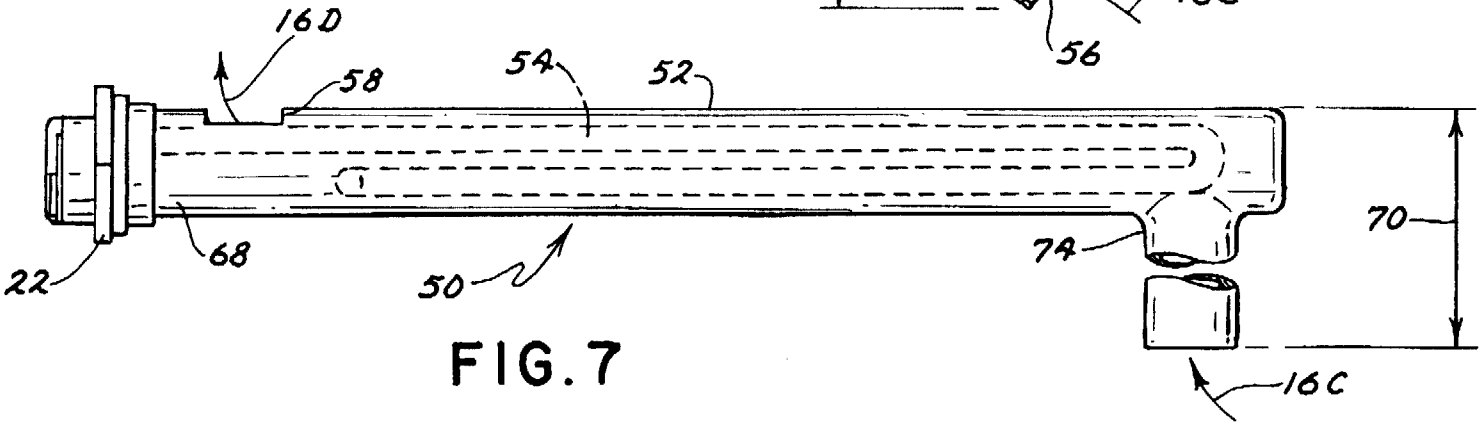
FIG. 7 is a side view of a further embodiment of the flow tube of the invention enclosing a sheath type water heater element.

In FIG. 7 a different type of tube inlet 56 is shown as at the lower end of a downcomer pipe 74 attached to a generally horizontal flow accelerator tube 52. A straight heating element 54 is contained within tube 52. The pipe 74 is of sufficient length to provide the desired elevation 70 for achieving a high acceleration of incoming water 16C through the tube to minimize scale adherence to the element 54. Addition of the downcomer pipe 74 to the tube 52 may make it difficult to remove the tube through a water heater port. Thus, the proximate end 68 of tube 52 may be detachably secured to the mount 22 so that the element 54 may be easily removed for replacement or repair. The tube 52 may be attached by screws or other connectors to the mount 22.

Figure 8:
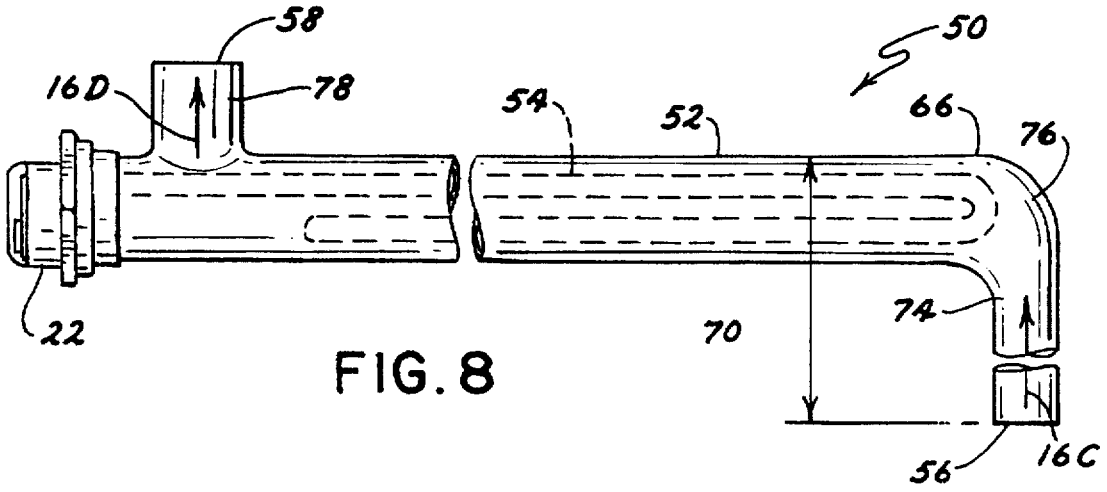
FIG. 8 is a side view of another embodiment of the flow tube of the invention enclosing a sheath type water heater element.

As shown in FIG. 8, the downcomer 74 may include an elbow portion 76 on the distal end 66 of the flow accelerator tube 52. Elbow 76 may be formed by bending the end 66 of tube 52.

In FIGS. 4–7, the tube outlet 58 is shown as comprising a rectangular opening in the upper side of the proximate end 68 of the tube 52. However, the tube outlet 58 may be of other shape, and alternatively may include an "upriser" pipe 78 (see FIG. 8) for discharging heated water 16D at a higher elevation. By adjusting the size of the inlet and outlet openings 56 and 58, the water velocity through tube 52 may be increased or decreased to promote the best cleaning action.

Figure 9:
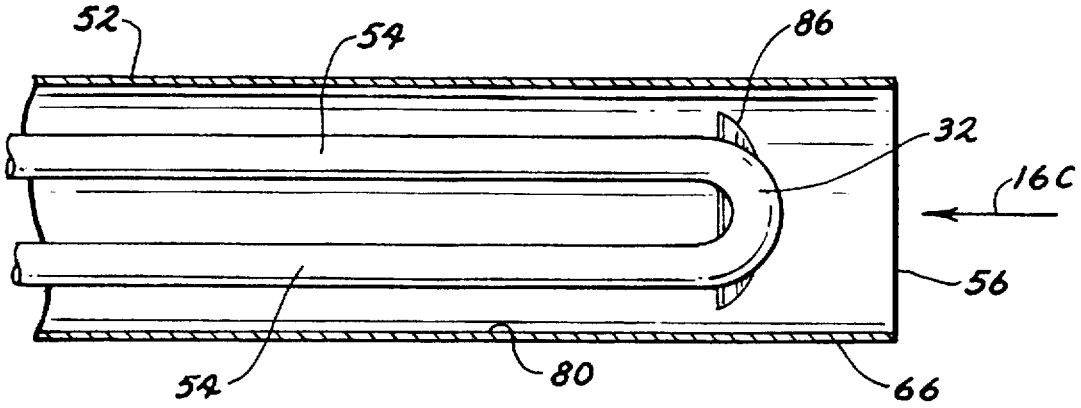
FIG. 9 is a sectional side view of another embodiment of the flow accelerator tube of the invention enclosing a sheath type water heater element.
Figure 10:
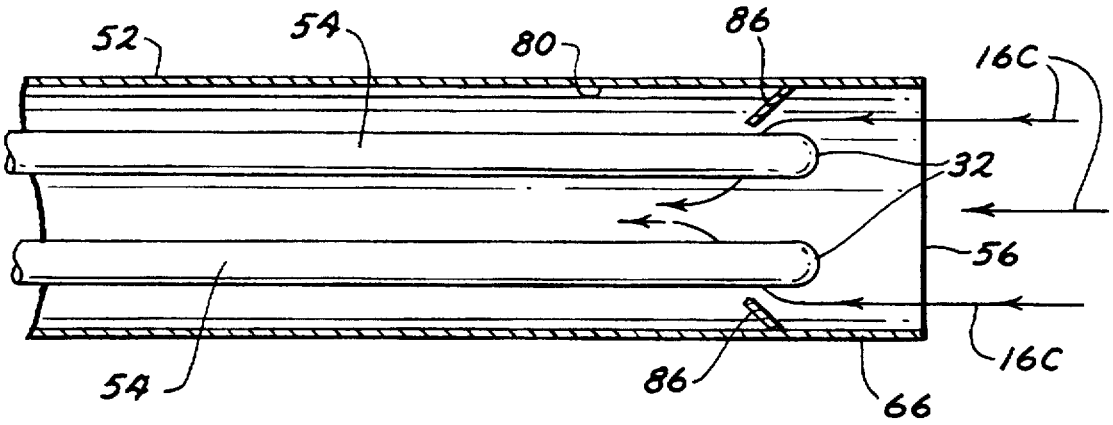
FIG. 10 is a sectional top view of another embodiment of the flow accelerator tube of the invention enclosing a sheath type water heater element.

The invention is most beneficial when the incoming water 16C is directed at the internal portions of the bends 30, 32. In FIGS. 9 and 10, baffles 86 are attached to the internal tube surface 80 near the distal end 66 of flow accelerator tube 52. The baffles 86 direct the fast moving water 16C at the internal portions of the bends 30, 32 to (a) provide a high temperature difference to increase heat transfer and (b) scour scale particles from those surfaces most prone to scaling. The baffles 86 may be of any design which directs the water 16C into the interior bend areas. In an alternative arrangement, the baffles 86 may be attached to the element.

Figure 11:
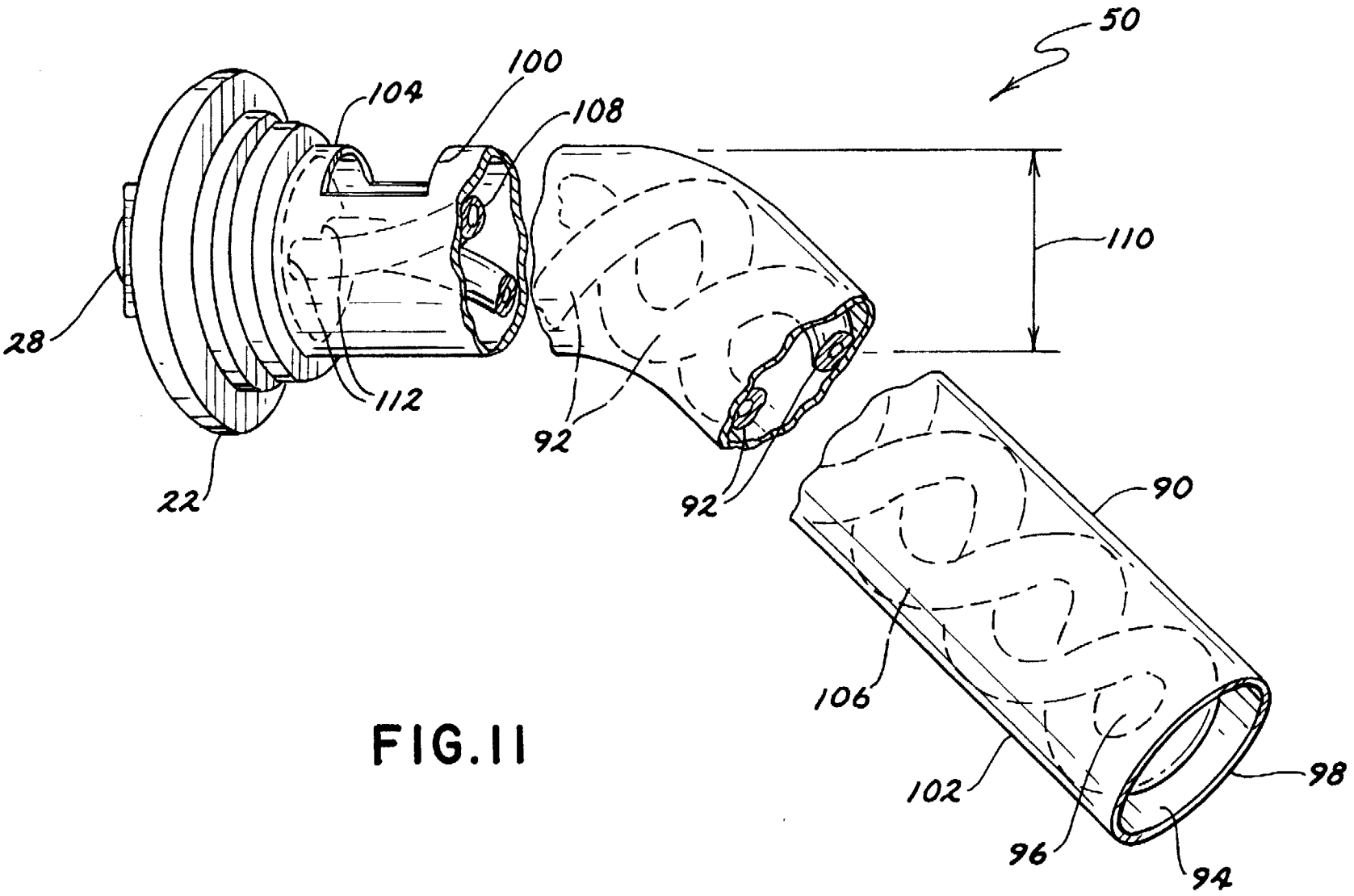
FIG. 11 is a partially cutaway perspective view of another embodiment of the flow accelerator tube of the invention.

Turning now to FIG. 11, a different embodiment of the water heating apparatus 50 comprises a flow accelerator tube 90 having a heating element 92 immediately adjacent to its internal surface 94. The heating element 92 may be either attached or unattached to the tube surface 94 as a continuous coil 106 forming a double helix, as in FIG. 11. The sheath 108 of heating element 92 may have a cross-section of any shape, but in a preferred embodiment, has a cross-section such that when coiled, the outer surface of the sheath will be conformed to the inner diameter 110 of the tube 90, having substantial contact with the tube interior surface 94. This configuration is preferred for attaching the element 92 to the tube interior surface 94. The attachment may be with clips or by cementation, spot welding or other appropriate method. Cementation with a high heat transfer cement is advantageous. The terminal ends 112 of the heating element 92 are sealingly attached to, or pass through the mount 22 so that the resistance wire within the element is connected at terminals 28 to a power source.

Figure 12:
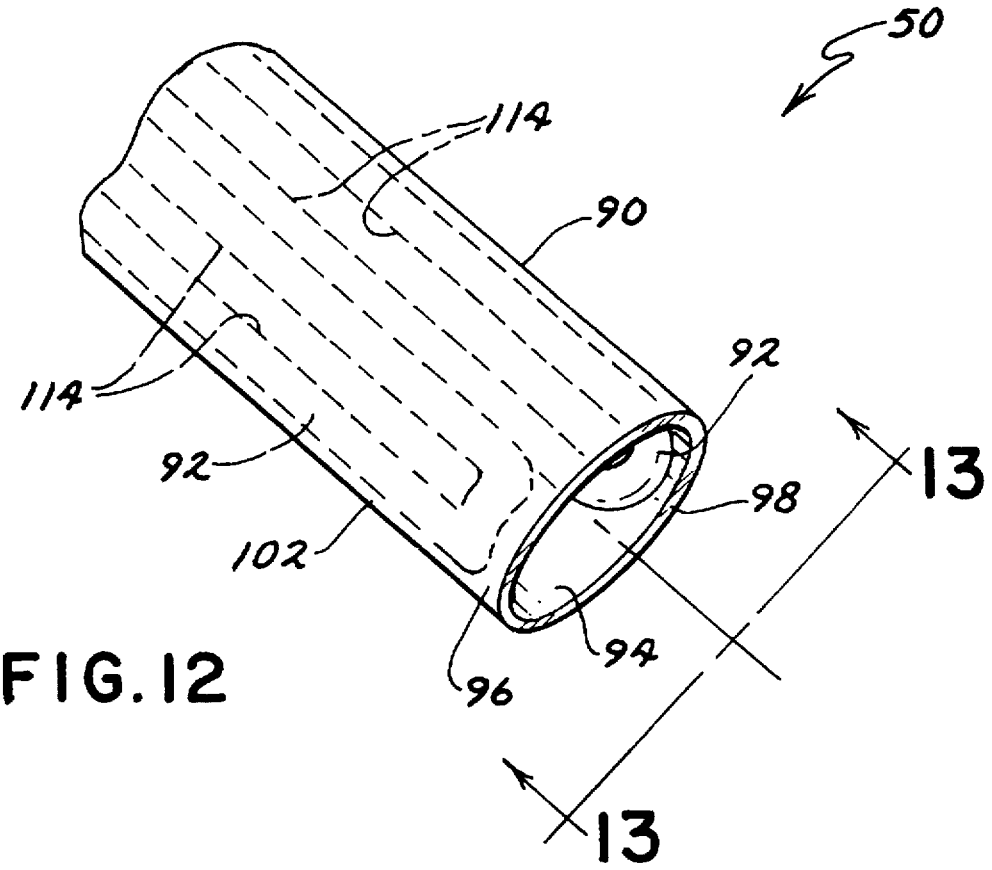
FIG. 12 is a partially cutaway perspective view of the distal end of a flow accelerator tube of another embodiment of the invention.
Figure 13:
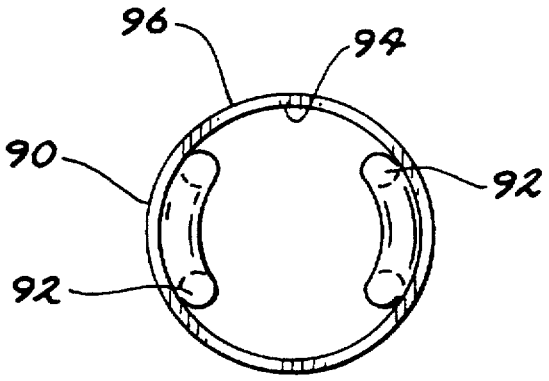
FIG. 13 is a sectional end view of a flow accelerator tube of the invention, as taken along line 13—13 of FIG. 12.

In an alternative configuration, the heating element 92 may be formed as a plurality of straight runs 114 parallel to the tube 90, as in FIGS. 12 and 13.

In the embodiments of FIGS. 11, 12 and 13, the tube 90 substantially increases the effective heat transfer surface area, and acts as a heat sink, lowering the temperature of the element 92. Both the internal surface 94 and external surface 96 of the flow accelerator tube 90 act as heat transfer surfaces. A high water velocity is generated within the flow accelerator tube 90, and the result is prolonged high heat transfer without excessively high element temperatures leading to failure.

Figure 14:
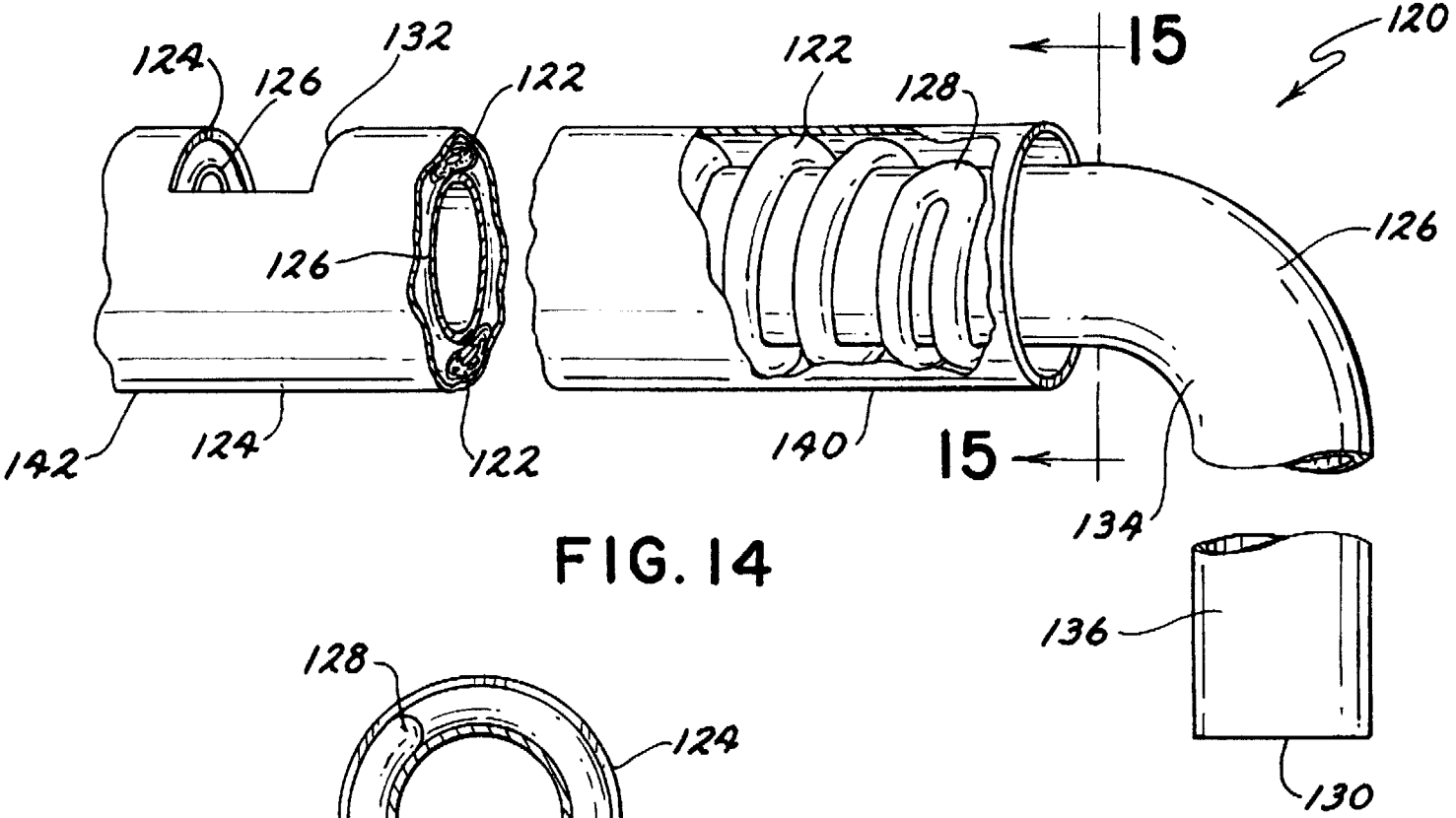
FIG. 14 is a partially cutaway perspective view of a portion of a double-tube flow accelerator tube of the invention.
Figure 15:
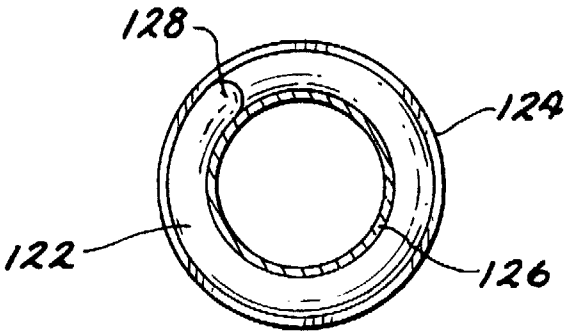
FIG. 15 is a sectional end view of a double-tube flow accelerator tube of the invention, as taken along line 15—15 of FIG. 14.

As illustrated in FIG. 14, a double-wall flow accelerator tube 120 has an electrical heating element 122 between the outer wall 124 and the inner wall 126. The element 122 is preferred to be in intimate contact with at least one of the walls 124 or 126, more preferably to at least the inner wall 126, for ensuring a high rate of heat transfer. Most preferably, the element 122 is welded, cemented or otherwise attached to the inner wall. The element 122 is shown as having a return bend 128.

In an alternative arrangement not specifically illustrated, the element 122 may comprise straight elongate sections parallel to the tubes 124, 126, and have return bends at the distal end 140 and at proximate end 142.

The tube inlet 130 for the double-wall flow accelerator tube 120 may be as generally described for the single-wall accelerators 52 and 90. Thus, the tube 120 may have an intermediate downward bend 134, or may be generally straight with a distal downcomer pipe 136. The downcomer pipe 136 is shown in FIG. 14 as an extension of inner tube 126 with a bend 134. The outlet 132 is shown as an upper section cut from the inner wall 126 and outer wall 124. In this version of the invention, a high rate of heat exchange to the water occurs at the outer surfaces of both the inner tube 126 and the outer tube 124.

Another version of the invention is illustrated in FIGS. 16–20. A sheath type heating element 154 is shown with mount 158. The scale reducing apparatus 150 comprises a mass of solid material enclosing a bend or bends 152 of the sheath type heating element 154. The scale reducing apparatus 150 is typically formed of a metal such as aluminum or magnesium and thus is highly conductive of heat. The scale reducing apparatus 150 has a greater heat transfer surface 156 with water contact than does the element bend(s) 152 which it covers. The rate of heat dissipation is greater; thus high temperatures which damage the resistance wire and sheath of the element 154 are avoided. The lower temperature leads to a much reduced rate of scale accumulation with a concomitant extension of element life.

Figure 16:
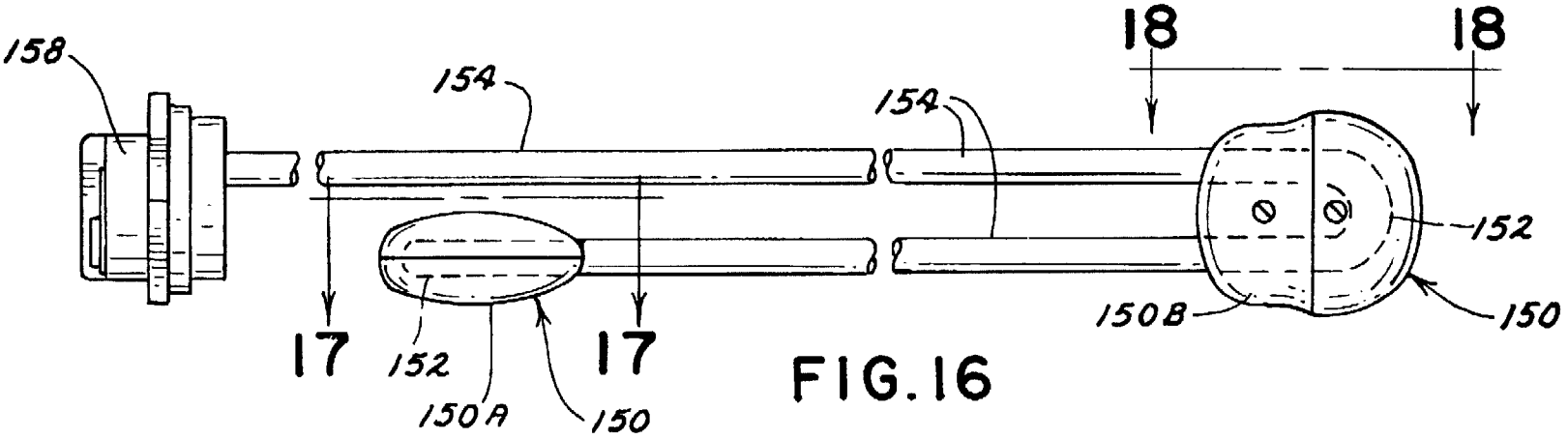
FIG. 16 is a side view of an apparatus of the invention for reducing scale formation on a water heater element.
Figure 18:
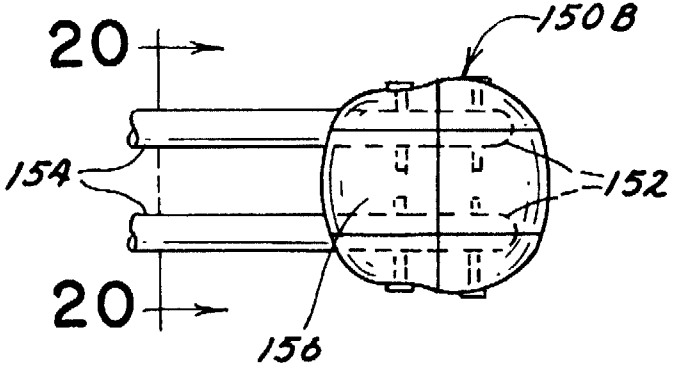
FIG. 18 is a plan view of an apparatus of the invention for reducing scale formation on two bends of an electrical heating element, as taken along line 18—18 of FIG. 16.
Figure 17:
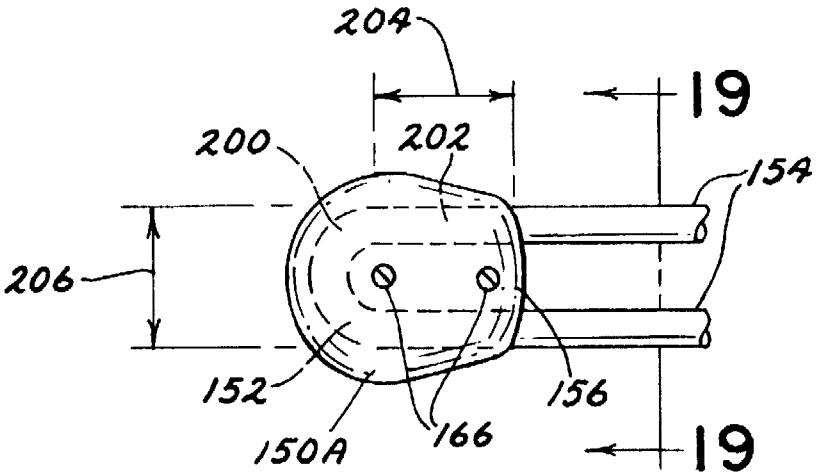
FIG. 17 is a plan view of an apparatus of the invention for reducing scale formation on a single bend of an electrical heating element, as taken along line 17—17 of FIG. 16.
Figure 19:
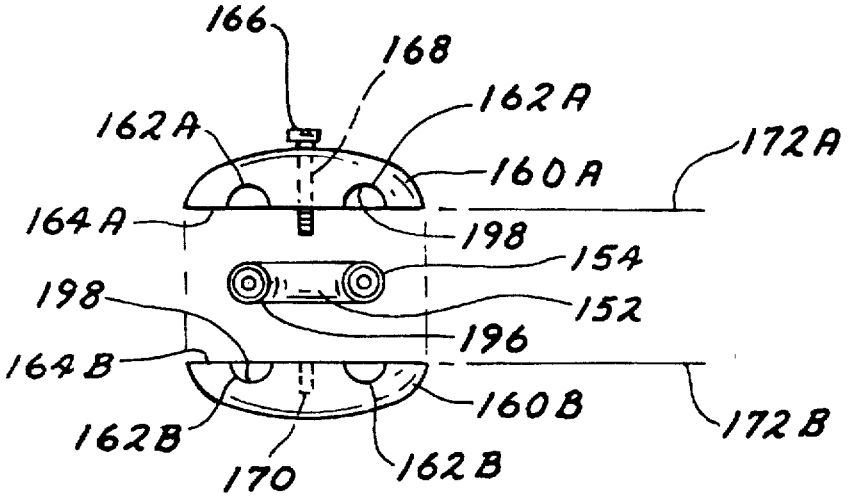
FIG. 19 is an exploded end view of an apparatus of the invention for reducing scale formation on a single bend of an electrical heating element, as taken along line 19—19 of FIG. 17.
Figure 20:
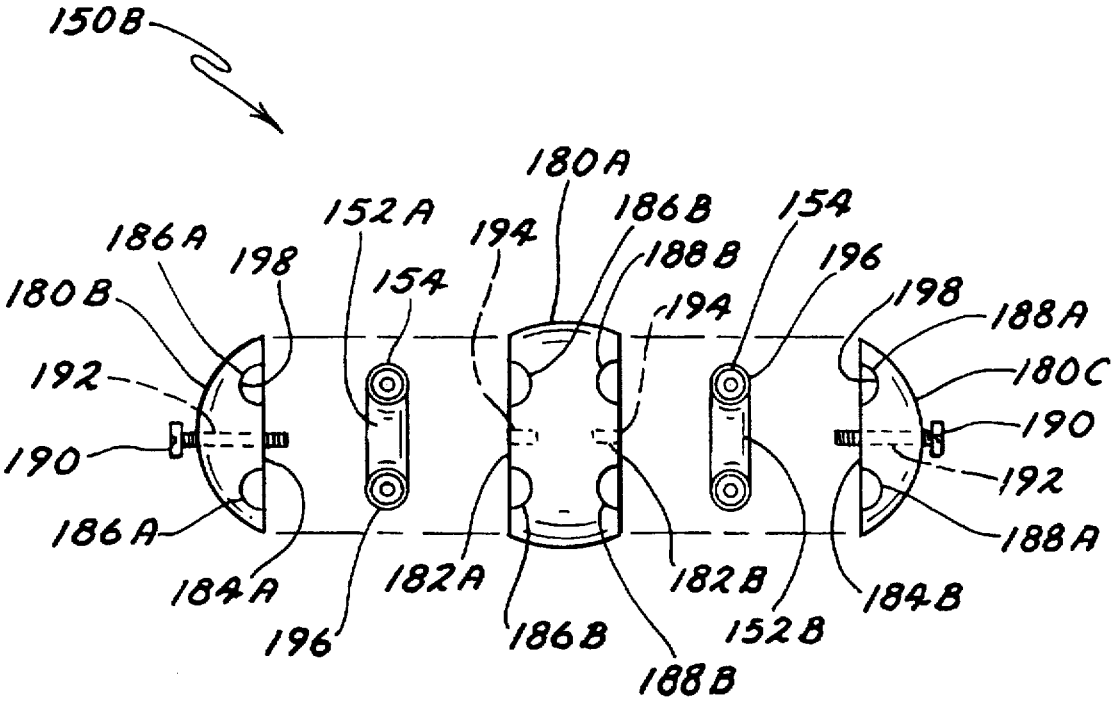
FIG. 20 is an exploded end view of an apparatus of the invention for reducing scale formation on two bends of an electrical heating element, as taken along line 20—20 of FIG. 18.

The scale reducing apparatus 150 is shown in several versions, as shown in FIGS. 16, 17 and 19 for accommodating a single element bend 152, and in FIGS. 16, 18 and 20 for accommodating two element bends 152. The apparatus 150 may be adapted for more than two adjacent parallel element bends where an element bundle contains such.

The exemplary single bend scale reducing apparatus 150A is shown in the exploded view of FIG. 19 as two nearly-identical sections 160A and 160B of typically cast metal with grooves 162A, 162B in which the element bend 152 of element 154 is to be closely held. The sections 160A and 160B have mating surfaces 164A and 164B, respectively, along which the sections are joined. The planes 172A, 172B of surfaces 164A, 164B, respectively, are shown as generally bisecting the element 154, and merge into a single plane when the sections 160A, 160B are joined together. The sections 160A, 160B are shown as being held together by screws 166 passing through screw-holes 168 and anchored in threaded holes 170. The two sections 160A, 160B may be alternatively joined by adhesive or by another mechanical method if desired. When joined together about the element bend 152, the sections become a heat sink which also increases the net heat transfer surface area for heating the water.

FIG. 20 illustrates a scale reducing apparatus 150B for two bends 152A, 152B of element 154. The apparatus 150B comprises a central section 180A, a left section 180B and a right section 180C. The central section 180A is shown with a left planar surface 182A and a right planar surface 182B. The left section 180B is shown with a right planar surface 184A which is mated to left planar surface 182A when the apparatus 150B is assembled. Likewise, the right section 180C is shown with a left planar surface 184B which is mated to right planar surface 182B when the apparatus is assembled.

Each of the surfaces 182A, 182B, 184A, 184B bisects a groove in the central section 180A and one of the left or right sections 180B, 180C for tightly retaining an element bend 152A or 152B in element 154. The grooves 186A and 186B together form a cavity into which the general bend portion 152A of element 154 is inserted. Likewise, the grooves 188A and 188B together form a cavity into which the bend portion 152B of element 154 is inserted.

As in the embodiment in FIG. 19, the mating surfaces 182A and 184A are abutted to hold the element bend 152A in mating grooves 186A, 186B. Likewise, mating surfaces 182B and 184B are abutted to hold the element bend 152B in mating grooves 188A, 188B. Screws 190 are shown as the passing through screw holes 192 in the left and right sections 180B, 180C and into screw seats 194, i.e. threaded holes in central section 180A.

In each of the embodiments of FIGS. 16–20, intimate contact between the scale reducing apparatus 150A, 150B and the element 154 may be increased by inserting a cement or other material having a high heat transfer coefficient between the element surface 196 and the groove surface 198 of the apparatus 150.

As illustrated in FIGS. 16–18, the scale reducing apparatus 150A, 150B has a tapered cross-section as a function of the linear distance from the bend, i.e. along the straight portion of the element. Thus, the transition from covered element to uncovered element is gradual, minimizing any temperature difference between the portion covered by apparatus 150 and the uncovered straight portion of the element 154.

The scale reducing apparatus 150A, 150B preferably encloses the arcuate portions 200 of the bends 152 as well as small length of the straight portions 202 of the element 154. The length 204 of a straight portion 202 enclosed by the apparatus 150A, 150B may be up to about 1.5 times the bend diameter 206 and more typically is equal to approximately 0.5–1.0 times the bend diameter.

In prior art water heaters, the sheath type element 154 tends to bend open at the distal bends, i.e. the lower portion of the element often drops from its original spacing from the upper portion. Often, the element must be cut and dropped into the water heater vessel in order to install a new element. As can be seen in FIG. 16, the scale reducing apparatus 150B of the invention holds the element runs in a generally constant position, enabling removal of the element 154 without cutting.

It is anticipated that various changes and modifications may be made in the construction, arrangement, operation and method of construction of the water heater improvements disclosed herein without departing from the spirit and scope of the invention as defined in the following claims.

What is claimed is:

1. An electrical heating apparatus for a water heater, comprising:

an elongate heating element comprising an electrical resistance wire surrounded by a sealed heat conducting sheath, said element having at least one end connectable to an element mount for sealed extension through a port in a wall of a water heater to an electric power supply, said sheath having at least one return bend and at least two elongated runs; and a member surrounding and enclosing a portion of said sheath for reducing scale formation on said sheath by enhancing heat transfer from said elongate element to a surrounding body of water, said member comprising a solid mass of metal surrounding at least one said return bend of said element and in intimate contact therewith to absorb thermal energy therefrom and transfer said thermal energy to said water.

2. The electrical heating apparatus of claim 1, wherein said mass has an external surface area exceeding the external surface area of said element surrounded thereby.

3. The electrical heating apparatus of claim 1, wherein said mass comprises two matching sections having mating plane surfaces with mating grooves therein for retaining said element bend therein, said element bend in intimate contact with said matching sections.

4. The electrical heating apparatus of claim 3, wherein said element bend is cemented in said mating grooves.

5. The electrical heating apparatus of claim 3, wherein said matching sections are joined by mechanical means.

6. The electrical heating apparatus of claim 1, wherein said mass comprises a central section having opposite plane surfaces with grooves therein for retaining first and second element bends therein, and left and right sections having plane surfaces with grooves for mating said surfaces of said central section.

* * * * *